United States Patent [19]

Nicol

[11] Patent Number: 5,044,899

[45] Date of Patent: Sep. 3, 1991

[54] FUEL PUMPING APPARATUS

[75] Inventor: Stuart W. Nicol, London, England

[73] Assignee: Lucas Industries, Birmingham, England

[21] Appl. No.: 532,313

[22] Filed: Jun. 1, 1990

[30] Foreign Application Priority Data

Jun. 3, 1989 [GB] United Kingdom ..... 8912824

[51] Int. Cl.[5] ..... F04B 29/00; F04B 23/00; F02M 37/04

[52] U.S. Cl. ..... 417/462; 417/440; 123/447; 123/450; 123/506

[58] Field of Search ..... 417/289, 462, 440; 123/450, 506, 497, 449

[56] References Cited

U.S. PATENT DOCUMENTS 4,224,903 9/1980 Mowbray ..... 123/506
4,393,844 7/1983 Skinner ..... 417/462
4,764,092 8/1988 Thornthwaite ..... 417/462
4,920,940 5/1990 Harris ..... 123/447
4,936,755 6/1990 Greeves ..... 417/462

*Primary Examiner*—Leonard E. Smith
*Assistant Examiner*—Peter Korytnyk
*Attorney, Agent, or Firm*—Abelman Frayne Rezac & Schwab

[57] ABSTRACT

A fuel pumping apparatus of the rotary distributor type is provided with a spill control muff on the distributor member and which controls flow of fuel from a bore containing the pumping plungers to a chamber. Slidable in the chamber is a spring loaded piston formed with a valve element which controls flow of fuel from the bore into the chamber through a spill passage. With the spill passage closed by the valve element deliver of fuel through an outlet takes place until fuel is admitted to the chamber under the control of the spill muff. The admission of fuel causing the piston to move the valve element to allow fuel into the spill passage through the spill passage.

6 Claims, 1 Drawing Sheet

FUEL PUMPING APPARATUS

This invention relates to a liquid fuel injection pumping apparatus of the kind comprising a rotary cylindrical distributor member mounted in a body, a bore formed in the distributor member and a pumping plunger mounted therein, a cam for imparting inward movement to the pumping plunger as the distributor member rotates, means for supplying fuel to the bore from a source of fuel under pressure to effect outward movement of the pumping plunger, further means for conveying fuel displaced by the pumping plunger to a plurality of outlet ports in turn and a control sleeve slidable on the distributor member for controlling the flow of fuel through a passage connected to said bore whereby the quantity of fuel which is delivered by the apparatus during inward movement of the pumping plunger can be controlled.

In known forms of apparatus of the aforesaid kind the fuel which flows through said passage flows to the interior of the apparatus. As a result the low pressure pump which constitutes the source of fuel under pressure even when only a small quantity of fuel is being supplied to the associated engine, must always supply fuel at the desired pressure and at a rate which is more than the maximum rate of fuel which can be supplied to the engine. Moreover, with modern fuel systems operating at high pressures, it is necessary to have high rates of spillage of fuel. The sleeve or the distributor member is provided with a groove or grooves and the distributor member or the sleeve is provided with a port which is uncovered by said groove to allow the spillage of fuel through said passage to occur. In order to increase the rate of spillage of fuel the port and groove must be increased in size and this can lead to excessive leakage of fuel during periods when the passage is closed. The object of the present invention is to provide an apparatus of the kind specified in a simple and convenient form.

According to the invention an apparatus of the kind specified comprising a spill passage communicating with said bore, said spill passage opening into a chamber, a spring loaded piston movable in said chamber and a valve element mounted on said piston, said valve element in use engaging a seating defined about said spill passage to prevent flow of fuel through the spill passage, said first mentioned passage communicating with said chamber whereby during inward movement of the plunger when fuel flows through said first mentioned passage into the chamber, the piston will be moved to lift the valve element from the seating thereby to open the spill passage, the spilled fuel collecting in said chamber and being returned to the bore prior to the next inward movement of the pumping plunger.

An example of an apparatus in accordance with the invention will now be described with reference to the accompanying drawings in which.

Figures 1, 2, 3:
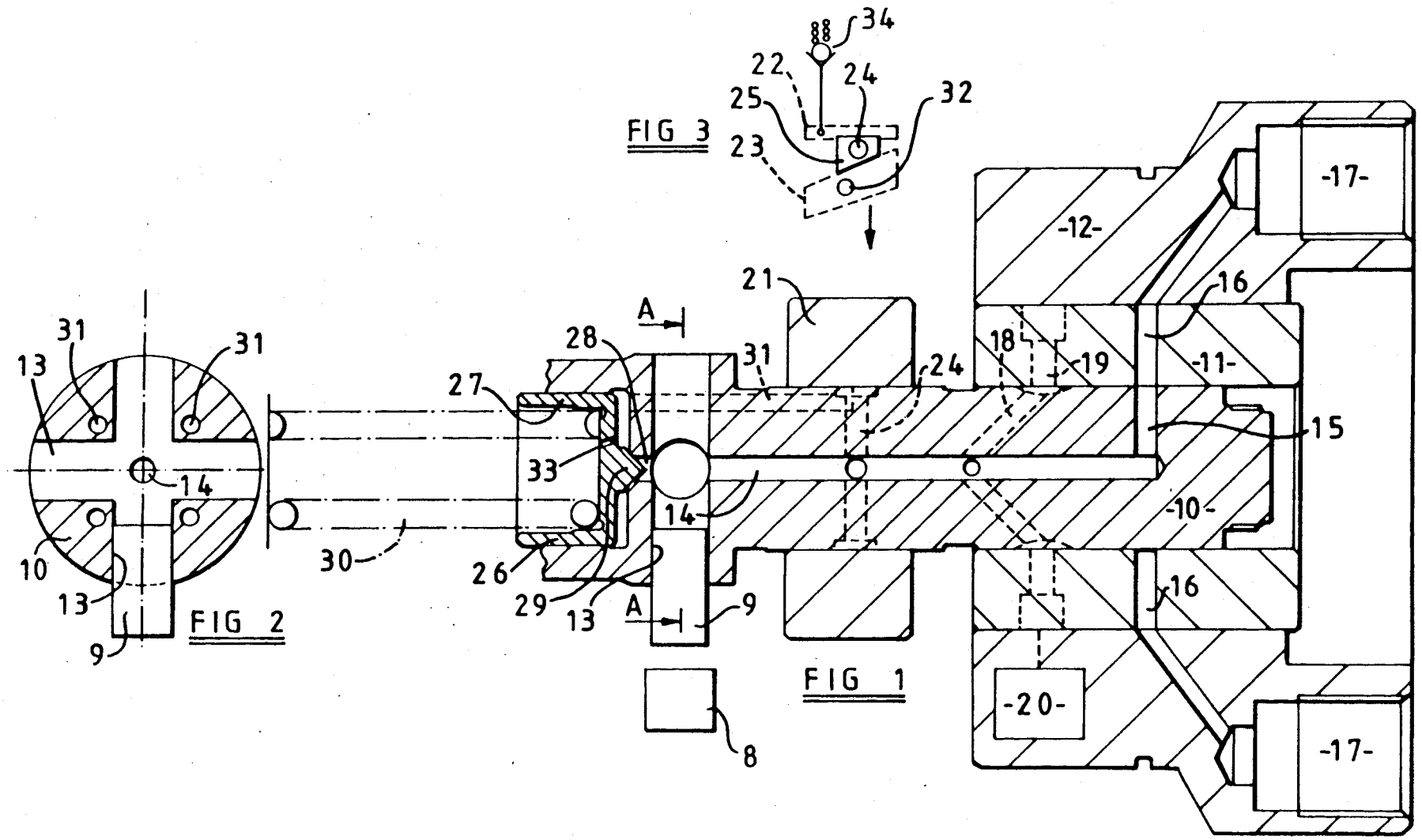
FIG. 1 is a diagrammatic sectional side elevation of the apparatus.
FIG. 2 is a section on the line A.A. of FIG. 1.
FIG. 3 is a developed view of part of the apparatus seen in FIG. 1.

Referring to the drawings the apparatus comprises a rotary cylindrical distributor member 10 which is mounted within a sleeve 11 secured within a housing 12. The distributor member is provided with in the particular example, a pair of diametrically disposed bores 13 in each of which is mounted a pumping plunger 9 only one of which is shown. At their outer ends the plungers are engaged in the usual manner, by cam followers (not shown), which in turn engage cam lobes formed on the internal peripheral surface of an annular cam ring 8 which is secured in the housing. The distributor member is driven in timed relationship with the associated engine.

At the inner ends of the plungers the bores communicate with an axially disposed passage 14 formed in the distributor member and which communicates with a delivery passage 15 opening onto the periphery of the distributor member. The passage 15 is arranged to register in turn with a plurality of outlet ports 16 which are formed in the sleeve and which communicate with outlets 17 formed in the housing. The outlets 17 in use are connected to the fuel injection nozzles respectively of the associated engine.

The passage 14 also communicates with four equiangularly spaced inlet passages 18 which extend to the periphery of the distributor member and which can communicate with inlet ports 19 formed in the sleeve and connected to the outlet of a low pressure fuel supply pump 20. Conveniently, the pump 20 is a vane type pump the rotary part of which is mounted on the distributor member. The pump 20 delivers fuel at a pressure which varies in accordance with the speed at which the apparatus is driven.

A portion of the distributor member lying between the sleeve 11 and an enlarged portion of the distributor member in which the bores 13 are formed, is surrounded by a sleeve 21. The sleeve commonly known in the art as a "spill muff" is utilised to control the amount of fuel which is supplied by the apparatus to the associated engine and it may be axially movable upon the distributor member by means of a governor mechanism not shown to vary the quantity of fuel delivered. It can also be angularly adjustable to vary the timing of fuel delivery.

On the internal peripheral surface of the sleeve 21 there is provided as shown in FIG. 3, two grooves 22 and 23. In the example, groove 22 is a simple rectangular groove with the longer sides being disposed parallel to the axis of rotation of the distributor member. The longer sides of the groove 23 are obliquely disposed. Moreover, communicating with the passage 14 are four radially extending passages 24 which open onto the periphery of the distributor member and formed in the distributor member at the outer end of each passage 24 is a recess 25 which is narrower than the grooves 22 and 23. During operation of the apparatus the sleeve 21 is restrained from rotation and the movement of the recess 25 relative to the sleeve and the grooves therein is indicated by the arrow in FIG. 3.

Also formed in the distributor member is an axially disposed cylindrical chamber 26 in which is slidably mounted a cup shaped piston 27. Opening into the base wall of the chamber is a spill passage 28 which communicates with the bores 13 intermediate their ends and formed on the piston member for engagement with a seating defined about the passage 28 is a valve element 29. The piston and valve element are biased by means of a coiled compression spring 30 so that the valve element engages the seating.

Also opening through the base wall of the chamber 26 are four passages 31 which open onto the periphery of the distributor member in ports 32 as illustrated in FIG. 3. The ports 32 are cirumferentially spaced from the recesses 25 in the direction of rotation of the distributor member.

In operation, as the distributor member rotates the delivery passage 15 will be brought into register with a delivery port 16 and during continued rotation of the distributor member the pumping plungers in the bores 13 will be moved inwardly by the cam lobes. Providing the passages 24 are closed, fuel will flow along the passage 14 to the respective outlet 17 and to the associated injection nozzle. This flow of fuel will continue until the recess 25 is brought into communication with the groove 23. As soon as this communication is established fuel will flow along one of the passages 31 into the chamber 26 and displacement of the piston 27 against the action of the spring 30 will take place. As soon as the piston starts to move the valve element 29 is lifted from its seating and fuel can then flow through the spill passage 28 into the chamber. The result is that there is a rapid reduction in the pressure of fuel which is supplied to the injection nozzle and the valve in the injection nozzle closes to terminate delivery of fuel to the engine. The flow of fuel into the chamber will continue until the cam followers move over the crests of the cam lobes. Shortly after the cam followers have moved over the crests of the cam lobes the delivery passage 15 moves out of register with the delivery port 16 and the inlet passages 18 move into register with the inlet ports 19.

The fuel contained within the cylindrical chamber is returned to the bores 13 to move the plungers outwardly and to permit the valve element to seat with the seating. Any fuel which has been lost due to leakage and also displaced to the engine, is made up with fresh fuel supplied by way of the passages 18 from the low pressure pump 20. During continued rotation of the distributor member the recess 25 moves over the groove 23 and the following recess 25 will then start to move over the groove 22. At this time filling of the bores is complete and the plungers have moved outwardly their maximum extent. The passages 18 will move out of register with the ports 19 and the delivery passage 15 will move into register with the following outlet port 16. As the plungers start to move inwardly by the cam lobes, the recess 25 will be in communication with the groove 22 and the groove 22 is in communication by way of a drilling, with the interior of the housing of the apparatus. Such fuel as is displaced by the plungers will flow through the drillings to the interior of the apparatus but this flow of fuel will cease when the recess 25 moves out of register with the groove 22. Delivery of fuel can take place and the cycle as described is repeated.

In FIG. 3 the axial setting of the sleeve is such that the recess 25 is in communication with either the groove 22 or the groove 23 and in this situation no fuel will be supplied to the associated engine. However, if the sleeve 21 is moved towards the right as seen in the drawings there will be an interval during which the recess 25 is out of communication with both grooves and it is during this interval that fuel is supplied to the associated engine.

It will be appreciated that some fuel is lost to the interior of the housing through the aforesaid drilling which connects the groove 22 with the interior of the housing and a further slight loss of fuel will occur through a restricted drilling 33 which is formed in the base wall of the piston. In addition, there can be a loss of fuel to the interior of the housing when during the filling of the bores 13, a recess 25 and a port 32 cross the groove 22. To minimize this loss of fuel the drilling which connects the groove 22 to the interior of the housing incorporates a spring-loaded pressurising valve 34. This valve can open to allow spillage of fuel displaced by the plungers but it remains closed at other times. The purpose of the drilling 33 is to ensure that the valve element 29 seats properly against the seating prior to the delivery of fuel and also to ensure that if any leakage occurs between the valve element and the seating there will not be a sufficient increase of pressure within the cylinder 26, to effect movement of the piston.

By the arrangement described rapid spillage of fuel during the inward movement of the plungers takes place and furthermore, most of the fuel which is spilled is returned to the bores 13 at the start of a filling strokes of the plungers.

I claim:

1. A liquid fuel injection pumping apparatus of the kind comprising a rotary cylindrical distributor member mounted in a body, a bore formed in the distributor member and a pumping plunger mounted therein, a cam for imparting inward movement to the pumping plunger as the distributor member rotates, means for supplying fuel to the bore from a source of fuel under pressure to effect outward movement of the pumping plunger, further means for conveying fuel displaced by the pumping plunger to a plurality of outlet ports in turn and a control sleeve slidable on the distributor member for controlling the flow of fuel through a passage connected to said bore whereby the quantity of fuel which is delivered by the apparatus during inward movement of the pumping plunger can be controlled characterised by a spill passage communicating with said bore, said spill passage opening into a chamber, a spring loaded piston movable in said chamber and a valve element mounted on said piston, said valve element in use engaging a seating defined about said spill passage to prevent flow of fuel through the spill passage, said first mentioned passage communicating with said chamber whereby during inward movement of the plunger when fuel flows through said first mentioned passage into the chamber, the piston will be moved to lift the valve element from the seating thereby to open the spill passage, the spilled fuel collecting in said chamber and being returned to the bore prior to the next inward movement of the pumping plunger.

2. An apparatus according to claim 1 including a restricted drilling extending between said chamber and a drain.

3. An apparatus according to claim 1 in which said first mentioned passage is formed in two parts which communicate with a pair of ports respectively opening onto the periphery of the distributor member and the sleeve is provided with a groove on its internal peripheral surface, said groove effecting communication between said pair of ports to allow fuel flow into said chamber.

4. An apparatus according to claim 3 in which the one of the pair of ports which communicates with the bore opens into a recess, the leading edge of which considered in terms of the direction of rotation of the distributor member, is inclined to the axis of the distributor member, the other of said pair of ports being positioned in advance of the one port and the groove having inclined leading and trailing edges.

5. An apparatus according to claim 4 including a further groove formed in the internal surface of the sleeve, said further groove being spaced from said first mentioned groove in the direction opposite to the direction of rotation of the distributor member, said further groove communicating with a drain and acting in conjunction with said recess to control the timing of the start of delivery of fuel through an outlet.

6. An apparatus according to claim 5 including a pressurizing valve through which said further groove communicates with the drain.

* * * * *